United States Patent [19]

Archer et al.

[11] 4,453,842

[45] Jun. 12, 1984

[54] DOUBLE JOURNAL ROLL FEED

[75] Inventors: James L. Archer; Richard A. Hampson, both of Charlotte, N.C.; Susumu Matsuda; Takashi Yagi, both of Shizuoka, Japan

[73] Assignees: International Business Machines Corporation, Armonk, N.Y.; Tokyo Electric Co., Ltd., Tokyo, Japan

[21] Appl. No.: 411,696

[22] Filed: Aug. 26, 1982

[30] Foreign Application Priority Data

Sep. 14, 1981 [JP] Japan ..... 56-145385

[51] Int. Cl.[3] ..... B41J 11/50; B41J 15/18

[52] U.S. Cl. ..... 400/605; 400/594; 400/613; 400/664; 226/11; 242/57

[58] Field of Search ..... 400/497, 499, 500, 501, 400/506, 519.2, 583, 586, 587, 590, 594, 605, 606, 609, 611, 613, 613.3, 613.4, 614, 617, 618, 619, 636, 42, 208, 664; 242/67.1 R, 67.1 D, 67.2, 67.3 R, 28, 37 R, 57, 75.4, 75.44, 189; 51/271; 60/908; 226/11, 45; 221/6

[56] References Cited

U.S. PATENT DOCUMENTS

| | | | |
|---|---|---|---|
| 1,792,557 | 2/1931 | Tynan | 400/609 |
| 1,825,783 | 10/1931 | Dunning et al. | 400/614 X |
| 2,510,626 | 6/1950 | Geisheck | 400/506 X |
| 2,896,944 | 7/1959 | Shiba | 226/11 |
| 2,973,081 | 2/1961 | Maidment et al. | 400/636 X |
| 3,077,919 | 2/1963 | Krueger | 242/67.3 R X |
| 3,356,202 | 12/1967 | Goff, Jr. | 400/208 |
| 3,583,183 | 6/1971 | McAninch | 60/908 X |
| 3,934,835 | 1/1976 | Maxwell | 242/67.2 |

OTHER PUBLICATIONS

*Western Electric Technical Digest,* "Low Paper Supply Alarm"; J. L. DeBoo; No. 47; pp. 3–4; Jul. 1977.

*Primary Examiner*—Edgar S. Burr
*Assistant Examiner*—David A. Wiecking
*Attorney, Agent, or Firm*—Frishauf, Holtz, Goodman & Woodward

[57] ABSTRACT

In a printer, a bail is attached to a wall of a supply chamber which contains a single supply roll. The bail has a pivot which allows the bail to pivot for providing access to the supply roll. A flexible web has one end attached to the wall of the supply chamber and the other end attached to a forward edge of the bail, and moves with the bail to resiliently contain blousing of paper from the supply roll.

5 Claims, 1 Drawing Figure

DOUBLE JOURNAL ROLL FEED

BACKGROUND OF THE INVENTION

It is well known that each layer of a double journal paper roll does not unwind at the same rate from a single supply roll. The difference in unwinding rate occurs because the outside paper layer lies at a greater radius and therefore has a larger circumference. When these two layers of journal paper are passed through feed rolls of a printer, the outer layer becomes loose around the supply roll. This looseness is called blousing. If the loose outer layer is contained tightly in the supply chamber, it will wrinkle and cause paper feeding jams. If the loose outer layer is allowed to expand without restriction, it may interfere with other mechanisms such as the takeup reel. Blousing is increased when the inner paper layer is wound on a takeup reel as the master journal and the outer paper layer is fed by friction to be torn off and used by the printer operator for such purposes as reconciling a cash drawer.

It is also recognized that the automatic sensing of exhausted paper is made more difficult when two layers of journal paper are simultaneously unwound from a single supply roll. Directly sensing an out of paper condition is made more difficult because both layers of paper from a double journal supply roll are not exhausted at the same time due to the problem of blousing described above. When the inner layer of journal paper is used as the master journal, it is usually covered by the outer layer and not visible to the operator. Because the inner layer of paper is a shorter web when unwound from a single supply reel, the inner layer is exhausted first. Because the inner layer is covered by the outer layer when viewed by the operator, the exhaustion of the inner layer master journal is not easy to notice by the operator. Because the outer layer is not exhausted, direct automatic sensing would require that the variation in thickness from a double layer to a single layer be detected.

One solution to the problem of blousing paper from a dual web supply roll is to eliminate the dual web supply roll and substitute therefor two single layer supply rolls. Providing separate supply rolls is effective but requires extra space and cost. Another attempt at solving the problem of blousing is described in U.S. Pat. No. 2,510,626. As can be seen from FIG. 3 of this patent, the outer layer having tendency to blouse is used as the master journal. The master journal takeup reel then provides tension tending to reel in the extra length of the outer layer. A problem is presented by U.S. Pat. No. 2,510,626 however in that the paper develops a curl while on the supply roll. This curl is such that the teller's audit journal which exits from the machine tends to curl forward toward the operator. The forward curl makes insertion of cut forms inconvenient and time consuming.

A different approach is described in U.S. Pat. No. 2,998,905. In this patent, feed wheel 10 acting on the outer layer 6' is made to rotate faster than platen 1 which is in contact with the inner layer. The outer layer 6' is then pushed upward faster than inner layer 6. Such difference in rotation speed may cause some papers to be marked by the feed wheel. Another potential problem is that depending upon variation in paper thickness etc., the difference in feed wheel speed may cause the inner layer to blouse.

SUMMARY OF THE INVENTION

These and other problems identified in the prior art are solved by applicant's invention which does not attempt to correct or eliminate the above described paper blousing but rather provides resilient means to contain blouse without causing the paper to fold or crease. Sensing means are provided as part of the resilient blouse containment apparatus to stop the printer as the paper becomes exhausted. The resilient containment apparatus includes a flexible web material mounted to a bail which can be pivoted out of the way for resupplying the printer with paper. The sensing switch serves to prevent machine operation until the bail and flexible web is restored to its normal operating position.

DETAILED DESCRIPTION OF THE PREFERRED EMBODIMENT

Figure 1:
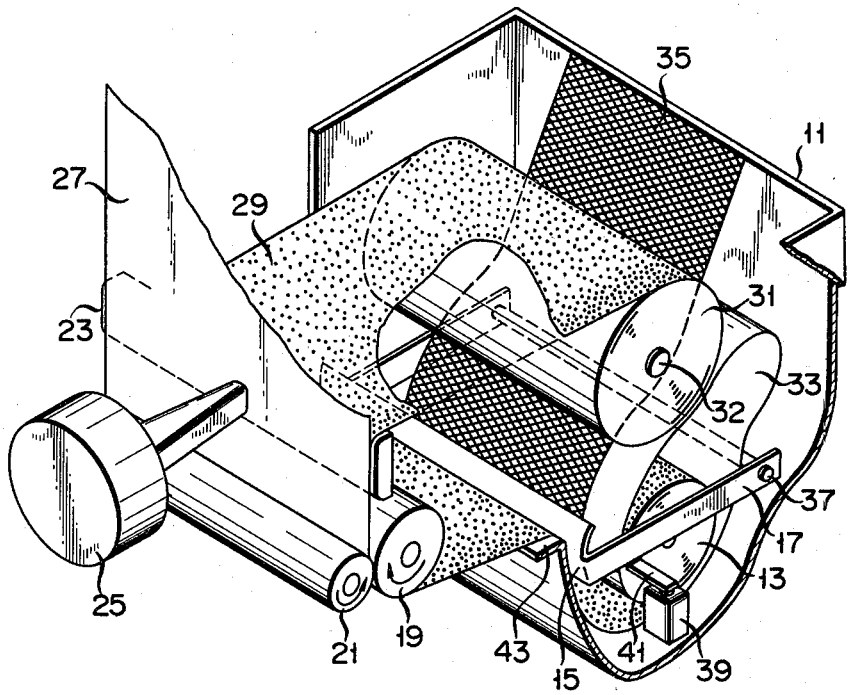
FIG. 1 shows an isometric view of a journal printer in accordance with the invention.

FIG. 1 shows a paper supply chamber for a teller station printer utilizing the resilient containment features of the invention. The supply chamber 11 is preferably a locked chamber containing a single supply roll 13 and a takeup reel 31. The supply roll 13 rests on the bottom of chamber 11. The supply roll 13 has two layers of journal paper wound thereon, at least the inner most layer 29 being fastened to a core of cardboard, wood, or the like to provide a measure of weight. The weight of the core assists in unwinding the more tightly curled paper near the center of the roll as the supply of paper becomes exhausted. Preferably, the paper layers 27 and 29 on the supply roll 13 are of the so called action paper variety which will develop a readable image from pressure alone without the need for carbon backing or ink ribbons.

After unwinding from the supply roll 13, the paper layers 27 and 29 pass under the forward edge or base portion 15 of a bail 17, to pinch or feed rolls 19 and 21. A narrow passage through which the journal paper is fed is formed between the forward edge 15 of the bail 17 and a front wall of the chamber 11. From the feed rolls 19 and 21, the paper layers are driven upward between platen 23 and print head 25. The feed rolls 19 and 21 are mounted using ordinary means so as to permit them to close together tightly to drive the paper layers without slippage yet open sufficiently at the beginning and end of printing operations to permit insertion and removal of cut forms between the print head 25 and the journal paper. The outermost layer 27 of the journal paper exits directly from the printer for observation and later use by the teller when reconciling the cash in the cash box for example with the transactions completed during a several hour interval. Because cut forms are to be inserted in front of the layer 27, it is important that the natural curl of the layer 27 direct the exiting journal paper rearward and away from the operator thereby posing a minimum of interference with machine operation yet remains available for continuous reference during current transactions and convenient review of earlier transactions. Also it is convenient if the printed image is on the outside of the natural paper curl so that the journal will tend to curl downward and lie flatter when sections thereof are later torn off for review. The paper layer 29 does not exit from the machine, but instead is wound onto a takeup reel 31 for use as the master audit journal. The layer 29 is the innermost layer of journal paper being unwound from the supply roll 13. The takeup reel 31 is detachably mounted on the side wall of the chamber 11. When mounted on the side wall, it is connected to a drive shaft (not shown) in a conventional manner to receive a driving force from the drive shaft.

Because of the finite thickness of the paper layers 27 and 29, the layer 29 lies at a greater radius from the center of the supply roll 13 and accordingly comprises a longer circumference. For each revolution of the supply roll 13 while unwinding the layers 27 and 29, slightly more of the layer 27 is unwound than of the layer 29. This extra length of the layer 27 blouses as shown at 33 around the supply roll 13.

If not restrained, the blouse 33 will become entrained into the nip of the takeup reel 31 causing a jam. Alternately, if the blouse 33 is rigidly restrained, it will cause creases and folds to be made in paper layer 27 which will cause a paper jam as the layer 27 is driven between the print head 25 and the platen 23.

The pivoting bail 17 and a flexible web means 35 such as cloth or the like is used in this invention to provide a resilient restraint of blouse 33 while at the same time permitting easy access to both the takeup reel 31 and the supply roll 13 in the same lockable journal chamber 11. The bail 17 is generally U shaped and its legs are pivoted on a pivot or hinge rod 37 near the rear wall of the chamber 11. The rod 37 is secured to the side wall of the chamber 11 through a suitable fixing means. The base portion 15 of the bail 17 is attached to one end of the cloth web 35. The opposite end of the cloth web 35 is fastened to the rear wall of the chamber 11 to provide a resilient yet restraining divider between the supply roll 13 and the takeup reel 31. As the supply roll 13 becomes exhausted and the takeup reel 31 fills, the blouse 33 of the outer layer 27 is restrained to form a free flowing path partially enveloping the takeup reel 31 to efficiently use chamber volume without danger of interfering with the winding of the layer 29 onto the takeup reel 31. Although efficiently restraining the blouse 33, the bail 17 conveniently pivots upward and to the rear for easy replacement of the supply roll 13.

A further feature of the invention involves the combination of the bail 17 with a sensing switch 39. The bail 17 has a switch operating member 41 integrally mounted thereon. The switch 39 serves the dual purposes of preventing machine operation if a supervisory person fails to return the bail 17 to its operating position after replacing the supply roll 13, and further halting the machine before the audit journal layer 29 is exhausted from the supply roll 13. The switch 39 is opened whenever the bail 17 is raised by a predetermined amount, since the switch operating member 41 disengages from the switch 39. Failing to return bail 17 to its operating position leaves the switch 39 open. As previously described, the paper layers 27 and 29 are fastened to the core of the supply roll 13. Since the paper layers 27 and 29 exit from beneath the edge 15 of the bail 17, the core of the supply roll 13 serves to raise the bail 17 sufficiently to stop printing.

What we claim is:

1. In a printer having a print head, a platen, a single supply roll having inner and outer layers of paper, a supply chamber which includes wall means for containing said single supply roll, and feed rolls for driving said inner and outer layers of paper from said supply roll past said platen and said print head, and causing formation of a blouse of said outer layer of paper, the improvement comprising:

a bail supported on said wall means of said supply chamber and being movable between a first operating position in which a feed passage for said inner and outer layers of paper is formed at a front portion of said supply chamber by said bail and said wall means,and a second position at which said bail is disposed at a rear portion of said supply chamber;

a switch coacting with said bail for sensing that said bail leaves said first operating position, for preventing at least printer operation when said bail leaves said first operating position;

said single supply roll having a core to which at least said inner layer of paper is secured, and wherein said core moves said bail from said first position when said inner layer of paper becomes exhausted; and a flexible web having one end attached to said bail and another end attached to said wall means at a rear portion of said supply chamber, said flexible web being arranged to contact a blouse of said outer layer of paper to thereby provide a restraint of said blouse of said outer layer of paper when said bail is in said first position.

2. The printer of claim 1, wherein said web extends above said supply roll and crosses a vertical plane which includes the rotational axis of said supply roll.

3. The printer of claim 1, wherein said bail is generally U-shaped, and has a base portion attached to said one end of said flexible web and a pair of legs which extend from said base portion and which are pivotably mounted to said wall means at the rear portion of said supply chamber, thereby pivotally mounting said bail to said wall means of said supply chamber.

4. The printer of claim 3, wherein said flexible web is made of cloth.

5. The printer of claim 1, wherein said web extends over said supply roll when said bail is in said first position, and is moved away from said supply roll to permit access to said supply roll when said bail is moved to said second position.

* * * * *